United States Patent [19]

Sherrick

[11] 3,965,825

[45] June 29, 1976

[54] RESILIENT TRUCK AXLE BEARING MOUNTING

[75] Inventor: James W. Sherrick, Edinboro, Pa.

[73] Assignee: Lord Corporation, Erie, Pa.

[22] Filed: Oct. 8, 1974

[21] Appl. No.: 513,187

[52] U.S. Cl. ..... 105/224.1; 105/222

[51] Int. Cl.[2] ..... B61F 5/28; B61F 5/30; B61F 5/38; B61F 15/12

[58] Field of Search ..... 105/224.1, 220, 222; 295/36

[56] References Cited

UNITED STATES PATENTS

| | | | |
|---|---|---|---|
| 2,207,848 | 7/1940 | Barrows | 105/224.1 |
| 2,299,051 | 10/1942 | Cottrell | 105/224.1 |
| 2,299,560 | 10/1942 | Travilla, Jr. | 105/222 |
| 3,006,290 | 10/1961 | Seelig, Jr. | 105/224.1 X |
| 3,211,112 | 10/1965 | Baker | 105/224.1 |
| 3,274,955 | 9/1966 | Thomas | 105/224.1 |
| 3,381,629 | 5/1968 | Jones | 105/224.1 X |
| 3,618,533 | 11/1971 | Hirst | 105/224.1 |
| 3,621,792 | 11/1971 | Lich | 105/220 |
| 3,699,897 | 10/1972 | Sherrick | 105/224.1 X |

*Primary Examiner*—L. J. Paperner
*Assistant Examiner*—Howard Beltran
*Attorney, Agent, or Firm*—James W. Wright

[57] ABSTRACT

A unitary resilient elastomeric pad is positioned between the bearing adapter and side frame of a railway truck. The truck side frame includes downwardly depending pedestal jaws spaced fore and aft of a bearing carried by the axle and defines longitudinally a semi-cylindrical load carrying surface between the jaws. Transversely, the load carrying surface is chevron shaped. A bearing adapter is carried by the bearing and defines a load receiving surface in opposed relation to the load carrying surface for matingly receiving same. The elastomeric pad is disposed in compression load carrying relation between the load carrying and load receiving surfaces and conforms to and bears against these surfaces.

3 Claims, 2 Drawing Figures

RESILIENT TRUCK AXLE BEARING MOUNTING

Figure 1:
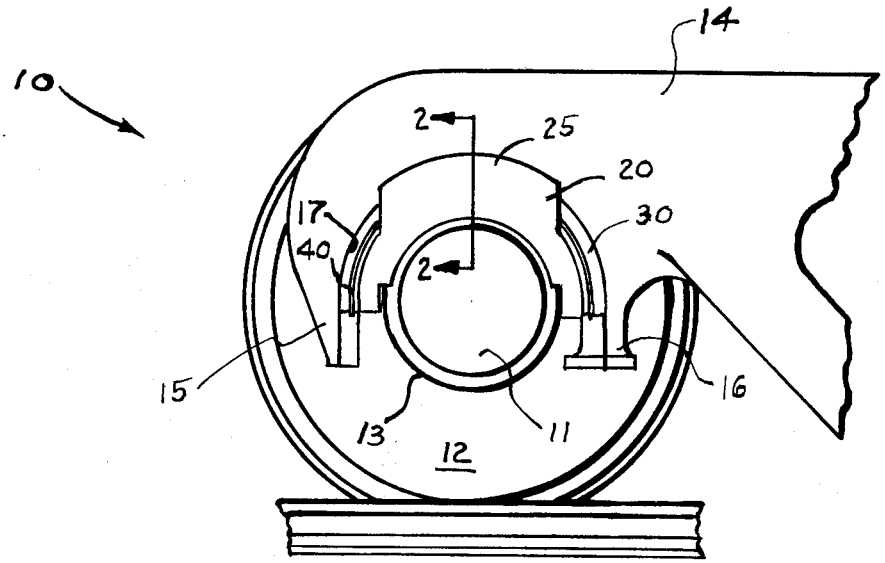

This invention relates to railway trucks and, more particularly, to a railway truck including a unitary resilient elastomeric pad positioned between the bearing adapter and side frames for enhancing the riding characteristics of the truck.

As is well known, the wheels of a railway truck are generally conical shaped such that a set of wheels spaced axially of an axle tend to keep the wheel set centered with respect to the track by continuously accommodating for irregularities in the tracks. This accommodation for track irregularities normally encompasses some shifting of the axle transversely to the tracks. In the past, railroad trucks have employed plain friction bearings for mounting the side frames to the axles. These plain friction bearings permit the axle to shift a limited amount transversely of the tracks prior to imparting similar transverse movement to the side frame and railway car carried by the truck.

However, in recent years for reasons that need not be discussed here, the railway industry has resorted to the use of anti-friction bearings, such as roller bearings, in new railway trucks. With the utilization of anti-friction bearings, very little, if any, movement of the axle transversely of the tracks relative to the side frame is permitted. Accordingly, the railway car carried by the truck is being continuously subjected to greater vibration and shock and shifted to cause excessive wear on various portions of the railway truck and car and damage to lading carried by the railway car. The effect of this action is to place critical limitations on permissible speeds of operation.

In an effort to alleviate these problems, specifically designed cooperating resilient means, bearing adapters and side frames have heretofore been provided in railway trucks. Typical prior art designs are shown in Barrows, U.S. Pat. No. 2,207,848; Travilla, U.S. Pat. No. 2,299,560; Thomas, U.S. Pat. No. 3,274,955; Jones, U.S. Pat. No. 3,381,629; and Sherrick, U.S. Pat. No. 3,699,897. These arrangements disclose the utilization of elastomer between the bearing and side frame. The elastomer is provided in load carrying relation therebetween to accommodate for the different motions experienced in truck operation and, in many instances, to eliminate any metal-to-metal contact between relative moving metal components. The predominant motions accommodated by such arrangements is movement of the axle relative to the side frame transversely of the tracks. While such arrangements have been found to lessen the severity of forces between the track and wheels and other truck and car components, various determinations indicate that further improvements are attainable by more specifically controlling the spring rates at the bearing longitudinally and transversely of the railway truck. In particular, a relatively high resistance to angular movement in a horizontal plane between the axle and side frame is desired to control oscillation or pivoting between the truck side frames and axles while remaining relatively soft transversely of the tracks.

Thus, it is an object of the present invention to provide a railway truck employing a resilient elastomeric pad between the side frame and axle bearing for improving the control of relative spring rates longitudinally and transversely of the railway truck.

Briefly, in accordance with the present invention, the above object is accomplished by providing in a railway truck an axle extending transversely of the truck, a bearing carried axially of said axle, and a side frame having downwardly depending pedestal jaws spaced fore and aft of the bearing and defining a load carrying surface therebetween positioned directly above the bearing. The load carrying surface is semi-cylindrical longitudinally of the side frame and chevron shaped axially of the axle. A bearing adapter overlies and is carried by the bearing for movement therewith and defines a load receiving surface spaced directly beneath and presented toward the load carrying surface. The load receiving surface is complementary to the load carrying surface for matingly receiving same in opposed relation thereto. A unitary resilient elastomeric pad is disposed in compression load carrying relation between said load carrying and load receiving surfaces. The pad conforms to and bears on said surfaces.

Figure 2:
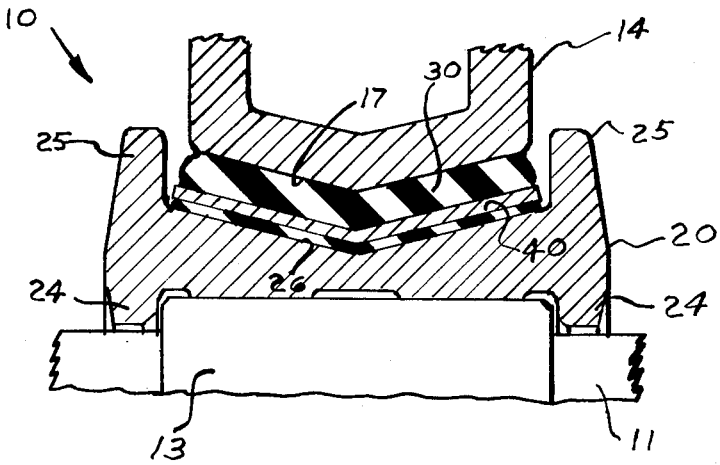

Some of the objects of the invention having been stated, other objects will appear as the description proceeds, when taken in connection with the accompanying drawings, in which:

FIG. 1 is a fragmentary side elevational view of a portion of a railway truck constructed in accordance with the present invention; and FIG. 2 is an enlarged fragmentary sectional view taken substantially along the line 2—2 of FIG. 1.

Referring more specifically to the drawings, there is illustrated in FIG. 1 a fragmentary view of a railway truck, generally indicated at 10, constructed in accordance with the present invention. As illustrated, the railway truck 10 comprises an axle 11 which extends transversely of the truck 10. Wheels 12, only one of which is shown, are mounted on axle 11 adjacent opposite ends thereof for rotation therewith. An anti-friction bearing 13, such as a roller bearing, is suitably carried axially of the axle outwardly of the wheels 12. Side frames 14, only one of which is shown, are disposed longitudinally of the truck outwardly of the wheels 12 and have downwardly depending pedestal jaws 15 and 16 spaced fore and aft of the bearing 13. Between the pedestal jaws 15 and 16, the side frame 14 defines a downward presented load carrying surface 17. Surface 17 is semi-cylindrical longitudinally and chevron shaped transversely of the side frame 14. In this specific embodiment the apex of the chevron is downward from the legs of same with the legs having an included angle of about 160°.

A bearing adapter, generally indicated at 20 and as best illustrated in FIG. 2, is adapted to fit over and be received in overlying relation to and carried by the bearing 13. The adapter 20 includes downwardly depending lugs 24 spaced transversely relative to the truck on opposite sides thereof with the bearing 13 being received and locked therebetween to prevent relative movement axially of the axle. The adapter 20 further includes upwardly presented lugs 25 spaced transversely relative to the truck 10 on opposite ends thereof that straddle the side frame 14 to permit limited relative lateral movement between the side frame 14 and axle 11. A load receiving surface 26 is defined by the bearing adapter 20 between the lugs 25 and is spaced directly beneath and presented toward the load carrying surface 17 of the side frame 14. As with load carrying surface 17, load receiving surface 26 is semi-cylindrical longitudinally and chevron shaped transversely of the truck 10. The load receiving surface 26 is complementary to the load carrying surface 17 for matingly receiving same in opposed relation thereto as best shown in FIG. 2.

A unitary resilient elastomeric pad 30 is disposed in compression load carrying relation between the load carrying and load receiving surfaces 17 and 26, respectively. The pad 30 is semi-annular longitudinally of the truck 10 and chevron shaped transversely of the truck 10. The outer surface of the pad 30 conforms to and bears against the load carrying surface 17, and the inner surface of the pad 30 conforms to and bears against the load receiving surface 26. Preferably, as shown, the load carrying surface 17, load receiving surface 26 and pad 30 are concentric about the center or axis of rotation of the axle 11.

The load carrying ability and stability of the pad 30 is enhanced by a semi-annular rigid plate 40 disposed within and bonded to the pad 30 intermediate the inside and outside thereof. In the transverse direction, the plate 40 is chevron shaped corresponding to that of the load carrying and load receiving surfaces 17 and 26. The plate 40, while substantially increasing the compression load carrying ability of the pad 30, has little, if any, affect on the ability of the resilient pad 30 to shear and accommodate axial movement of the axle 11 relative to the side frame 14. The pad 30 may be formed of a natural or synthetic elastomer.

In operation, the static load of the side frames 14, railway car carried by the truck 10 and cargo of the car will be carried by compression loading of the pad 30. Due to its semi-annular and unitary construction, the static load will be distributed uniformly over a relatively large area. Any forces tending to move the side frame 14 and axle 11 relative to each other axially of the axle 11 or transversely of the truck 10 will be resiliently accommodated by combined shearing and compression loading of the pad 30. The chevron contour provides the compression loading. Due to the relatively large included angle between the legs of the pad 30, motion will be accommodated predominately in shear. Thus, the spring rate between the axle 11 and side frame 14 transversely of the truck 10 will be low to permit sufficient transverse relative motion therebetween. The extent to which the axle 11 and side frame 14 can move relative to each other axially of the axle 11 is limited by the clearance between the bearing adapter lugs 25 and side frame 14. A typical clearance would be about one-half inch. In the fore and aft direction or longitudinally of the truck 10, FIG. 1, forces load the pad 30 in compression, thus rendering it relatively stiff. This is desired to prevent oscillation or pivoting between the side frames 14 and axles 11. The chevron contour of the pad 30 transversely of the truck

10 also enhances the resistance to oscillation between the side frames 14 and axles 11. Typical spring rates for the embodiment described are 225,000 lbs./in. vertically; 40,000 lbs./in. transversely; and 175,000 lbs./in. longitudinally.

In the drawings and specification, there has been set forth a preferred embodiment of the invention and, although specific terms are employed, they are used in a generic and descriptive sense only and not for purposes of limitation.

What is claimed is:

1. In a railway truck, an axle extending transversely of said truck, an anti-friction bearing carried axially of said axle, an elongate side frame orientated transversely of said axle having downwardly depending pedestal jaws spaced fore and aft of said bearing and defining longitudinally therebetween a V-shaped downwardly facing load carrying surface positioned directly above said bearing, said load carrying surface being concentric to and about said axle from the fore to the aft side of said bearing with the apex thereof disposed inwardly toward said axle and extending longitudinally of said side frame, a rigid bearing adapter overlying and carried by and in contact with said bearing, said bearing adapter having a V-shaped upwardly facing load receiving surface spaced directly beneath and presented toward said load carrying surface of said side frame, said load receiving surface being concentric to and about said axle from the fore to the aft side of side bearing with the apex thereof disposed upwardly toward said axle and extending longitudinally of said side frame, said load receiving surface matingly receiving said load carrying surface in opposed relation thereto, and a unitary semi-annular resilient elastomeric pad disposed in compression load carrying relation between said load carrying and load receiving surfaces, said pad conforming to and bearing on said load carrying and load receiving surfaces.

2. In a railway truck, as set forth in claim 1, wherein said resilient elastomeric pad includes a rigid arcuate reinforcing plate embedded therein.

3. In a railway truck, as set forth in claim 1, wherein said bearing adapter includes rigid lugs spaced on opposite ends thereof axially of said axle extending upwardly beyond said load carrying surface and straddling said side frame to permit limited relative lateral movement between said side frame and axle.

* * * * *

UNITED STATES PATENT OFFICE

CERTIFICATE OF CORRECTION

PATENT NO. : 3,965,825

DATED : June 29, 1976

INVENTOR(S) : James W. Sherrick

It is certified that error appears in the above-identified patent and that said Letters Patent are hereby corrected as shown below:

Column 4, lines 32-33 (claim 1) "upwardly" should be -- inwardly -- .

Signed and Sealed this

Twenty-first Day of December 1976

[SEAL]

*Attest:*

RUTH C. MASON
*Attesting Officer*

C. MARSHALL DANN
*Commissioner of Patents and Trademarks*